US008070377B2

(12) United States Patent
Wang

(10) Patent No.: US 8,070,377 B2
(45) Date of Patent: Dec. 6, 2011

(54) QUICK-RELEASE COUPLER

(76) Inventor: Tzu-Chien Wang, Tainan (TW)

( * ) Notice: Subject to any disclaimer, the term of this patent is extended or adjusted under 35 U.S.C. 154(b) by 182 days.

(21) Appl. No.: 12/618,825

(22) Filed: Nov. 16, 2009

(65) Prior Publication Data

US 2010/0054854 A1 Mar. 4, 2010

Related U.S. Application Data

(63) Continuation-in-part of application No. 12/044,037, filed on Mar. 7, 2008, now abandoned.

(51) Int. Cl.
*B25G 3/18* (2006.01)

(52) U.S. Cl. ..... 403/322.2; 403/325; 81/177.2; 81/177.85

(58) Field of Classification Search ..... 403/322.1, 403/322.2, 325, 327; 81/177.1, 177.2, 177.85
See application file for complete search history.

(56) References Cited

U.S. PATENT DOCUMENTS

| | | | | |
|---|---|---|---|---|
| 4,480,511 A | | 11/1984 | Nickipuck | 81/177.85 |
| 4,537,100 A | * | 8/1985 | Palm | 81/177.85 |
| 4,589,308 A | * | 5/1986 | Palm | 81/177.85 |
| 5,050,467 A | | 9/1991 | Brown et al. | 81/177.85 |
| 5,333,523 A | | 8/1994 | Palm | 81/177.85 |
| 6,354,176 B1 | | 3/2002 | Nordlin | 81/124.4 |
| 6,874,392 B1 | | 4/2005 | Wu | 81/177.85 |
| 7,225,709 B2 | | 6/2007 | Liao | 81/177.85 |
| 2004/0126182 A1 | * | 7/2004 | Lin | 403/322.2 |
| 2005/0145078 A1 | | 7/2005 | Chuan | 81/177.85 |
| 2007/0163406 A1 | | 7/2007 | Liu | 81/177.85 |
| 2008/0141835 A1 | * | 6/2008 | Davidson | 81/177.85 |

FOREIGN PATENT DOCUMENTS

EP 1457292 9/2004

* cited by examiner

*Primary Examiner* — Michael P Ferguson
(74) *Attorney, Agent, or Firm* — Alan Kamrath; Kamrath & Associates PA

(57) ABSTRACT

A quick-release coupler includes a rod having first and second sections. The first section includes an end for coupling with a pneumatic tool. The second section extends from the other end of the first section. A sleeve is slideably mounted around the rod and includes an end for releasably coupling a bit. The sleeve includes an axial bore having larger and smaller sections. The larger section has polygonal cross sections corresponding to polygonal cross sections of the first section. A radial bore is formed in the sleeve and in communication with the smaller section. A ball is moveably received in the radial bore and moveably received in a recess of the second section of the rod to releasably engage the sleeve with the bit. A spring is mounted in the larger section of the sleeve for biasing the sleeve towards the other end of the rod.

2 Claims, 9 Drawing Sheets

QUICK-RELEASE COUPLER

CROSS REFERENCE TO RELATED APPLICATION

This is a continuation-in-part application of U.S. patent application Ser. No. 12/044,037 filed Mar. 7, 2008 now abandoned.

BACKGROUND OF THE INVENTION

The present invention relates to a quick-release coupler and, more particularly, to a quick-release coupler for securely coupling a bit to a pneumatic tool while allowing easy assembly.

FIG. 1 shows a conventional quick-release coupler 2 and a bit 1 coupled to the quick-release coupler 2. Bit 1 includes a driving end 12 for driving a screw or the like and a socket portion 11 having a coupling hole 111. A recessed portion 112 is formed in each of four side walls defining coupling hole 111. Quick-release coupler 2 includes a first end 21 for coupling with a hand-held tool such as a pneumatic tool (not shown) and a second end 22 having a receptacle 221 in which a spring 23 and a ball 24 are received. Ball 24 is biased by spring 23 such that an outermost portion 241 of ball 24 projects out of receptacle 221 and engages in one of recessed portions 112 of bit 1 when coupling hole 111 of bit 1 is coupled to second end 22 of quick-release coupler 2. Thus, bit 1 is locked on quick-release coupler 2 and can be driven when first end 21 of quick-release coupler 2 secured to the pneumatic tool rotates.

To remove bit 1 from quick-release coupler 2, a user generally grasps bit 1 and a handle of the pneumatic tool to pull them away from each other to make ball 24 retract into receptacle 221 to allow removal of bit 1 from quick-release coupler 2. However, it is sometimes difficult to remove bit 1 from quick-release coupler 2, particularly when ball 24 is jammed or the hands of the user are greasy. Moreover, bit 1 may be disengaged from quick-release coupler 2 during operation of the pneumatic tool when the resilience of spring 23 decreases.

U.S. Pat. No. 6,874,392 discloses a connector for a hand tool including a connector seat coupled to an operation member. The connector seat includes a main body, a movable rod, a positioning ball, and at least one spring. The main body includes a square receiving portion having a positioning hole that partially receives the positioning ball. The main body is movable relative to an operation seat of the operation member to retract the positioning ball into a receiving cavity of the movable rod, so that a socket can be mounted on and detached from the connector easily and conveniently, thereby saving the manual work. However, aligning the receiving cavity of the movable rod with the positioning hole of the square receiving portion of the main body while inserting the movable rod into the main body is not always easy, for the movable rod having circular cross sections may rotate relative to the main body also having circular cross sections.

Thus, a need exists for a quick-release coupler to allow secure attachment and easy removal of a bit to and from a hand-held tool while allowing easy assembly of the quick-release coupler.

SUMMARY OF THE INVENTION

The present invention solves this need and other problems in the field of easy assembly of quick-release couplers by providing, in a preferred form, a quick-release coupler including a rod having first and second sections spaced in an axial direction. The first section has polygonal cross sections perpendicular to the axial direction and includes first and second ends spaced in the axial direction. The first end of the first section is adapted to couple with a pneumatic tool. The second section extends from an end face of the second end of the first section and includes a distal end having a recess. The recess includes a first contact section and a second contact section intermediate the first contact section and the end face of the first section in the axial direction. A depth from the first contact section in a radial direction perpendicular to the axial direction to an outer periphery of the second section of the rod is smaller than that from the second contact section to the outer periphery of the second section of the rod in the radial direction. A sleeve is mounted around the rod and moveable relative to the rod in the axial direction between an extended, first position and a retracted, second position. The sleeve includes first and second ends spaced in the axial direction. The second end of the sleeve is adapted to couple with a bit. An axial bore extends from the first end of the sleeve through the second end of the sleeve in the axial direction. The axial bore includes larger and smaller sections. The larger section has polygonal cross sections perpendicular to the axial direction and corresponding to the polygonal cross sections of the first section of the rod. A radial bore extends in the radial direction from an outer periphery of the second end of the sleeve through an inner periphery of the smaller section of the axial bore. The radial bore is aligned with the recess of the second section of the rod. A ball is movably received in the radial bore of sleeve in the radial direction and moveably received in the recess of the second section of the rod in the axial and radial directions. The ball releasably engages the sleeve with the rod. A spring is mounted in the larger section of the axial bore of the sleeve and biases the sleeve from the retracted, second position to the extended, first position. The spring is compressed when the sleeve is in the retracted, second position.

When the sleeve is in the extended, first position, the ball is engaged in the first contact section of the recess with an outermost portion of the ball projecting out of the radial bore of the sleeve, coupling the bit with the second end of the sleeve. On the other hand, when the sleeve is in the retracted, second position, the ball is engaged in the second contact section of the recess and does not project out of the radial bore of the sleeve, allowing the bit to be disengaged from the second end of the sleeve.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

Figure 1:
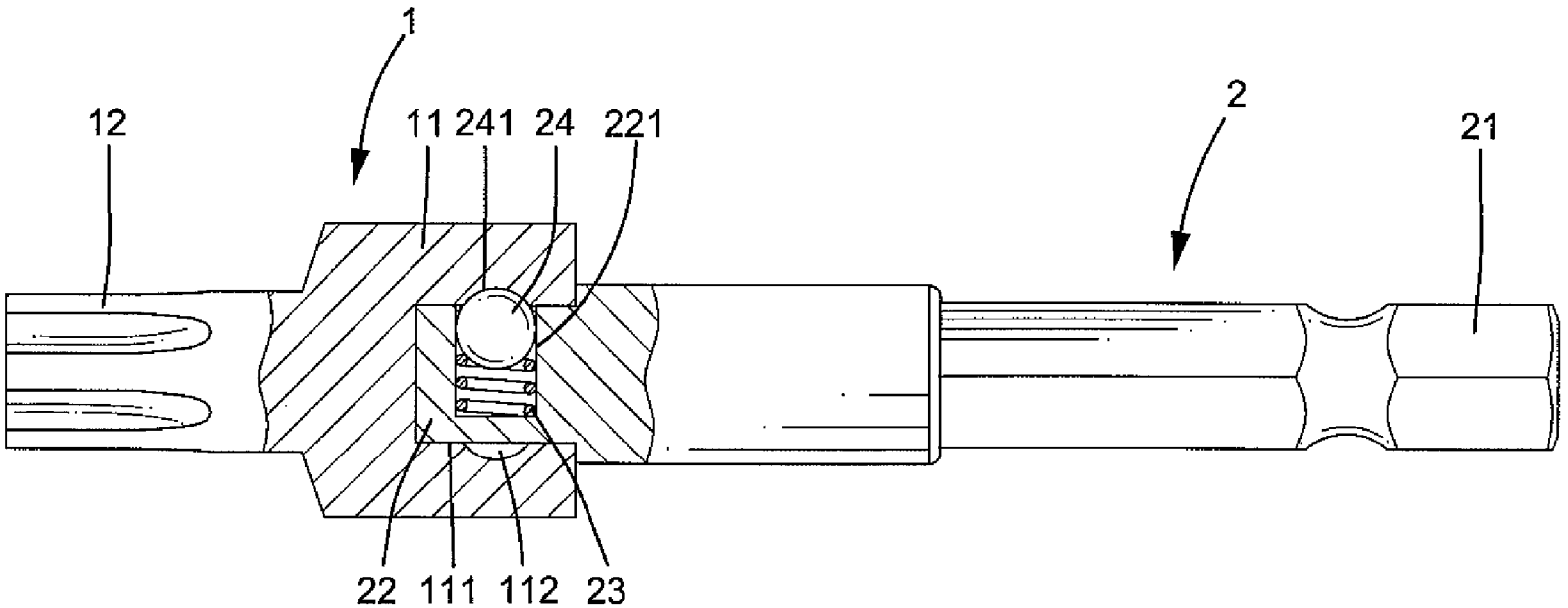
FIG.1 PRIOR ART
FIG. 1 is a partly cross-sectioned side view of a conventional quick-release coupler with a bit attached thereto.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "inner", "outer", "end", "portion", "section", "axial", "radial", "annular", "width", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

Figure 4:
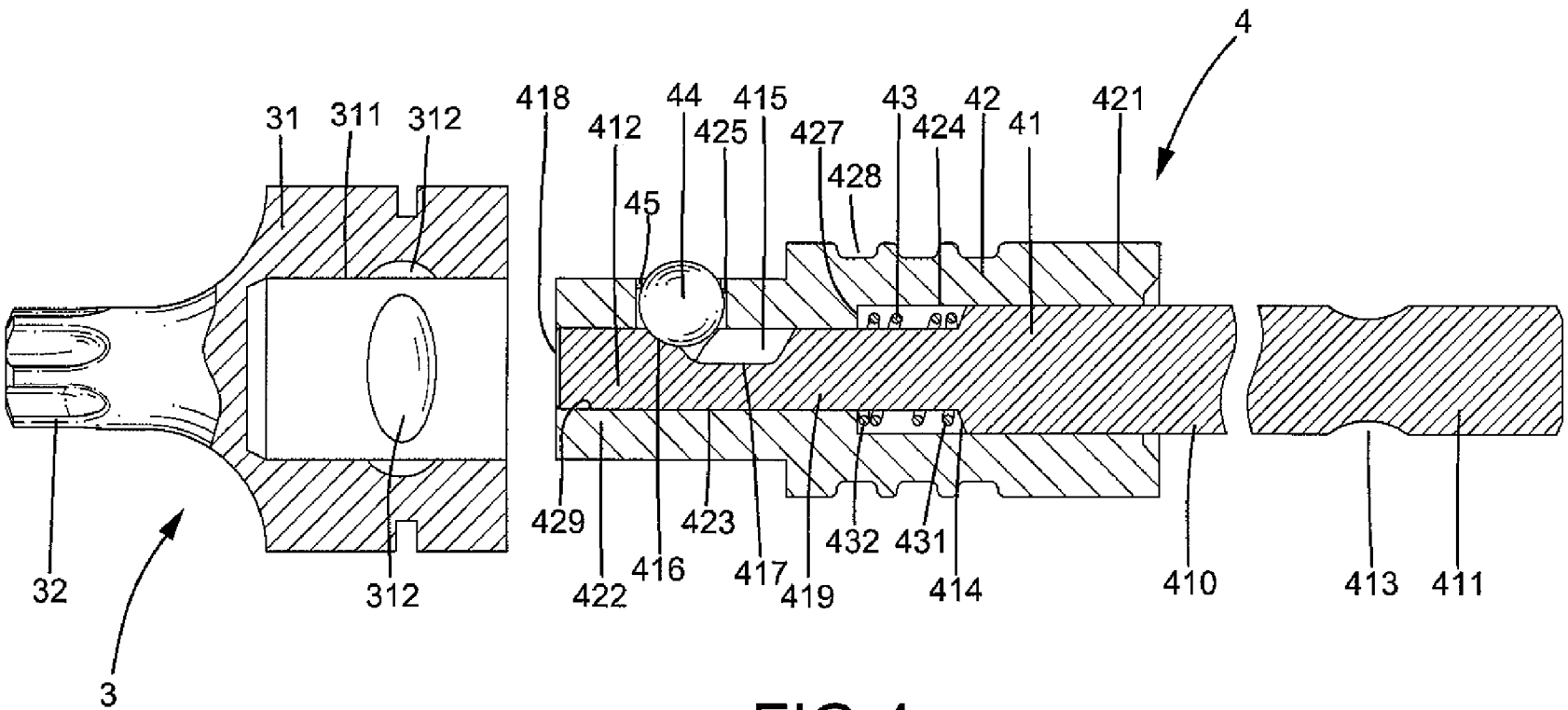
FIG. 4 shows a cross sectional view of the quick-release coupler and the bit of FIG. 2 before engagement.
Figure 5:
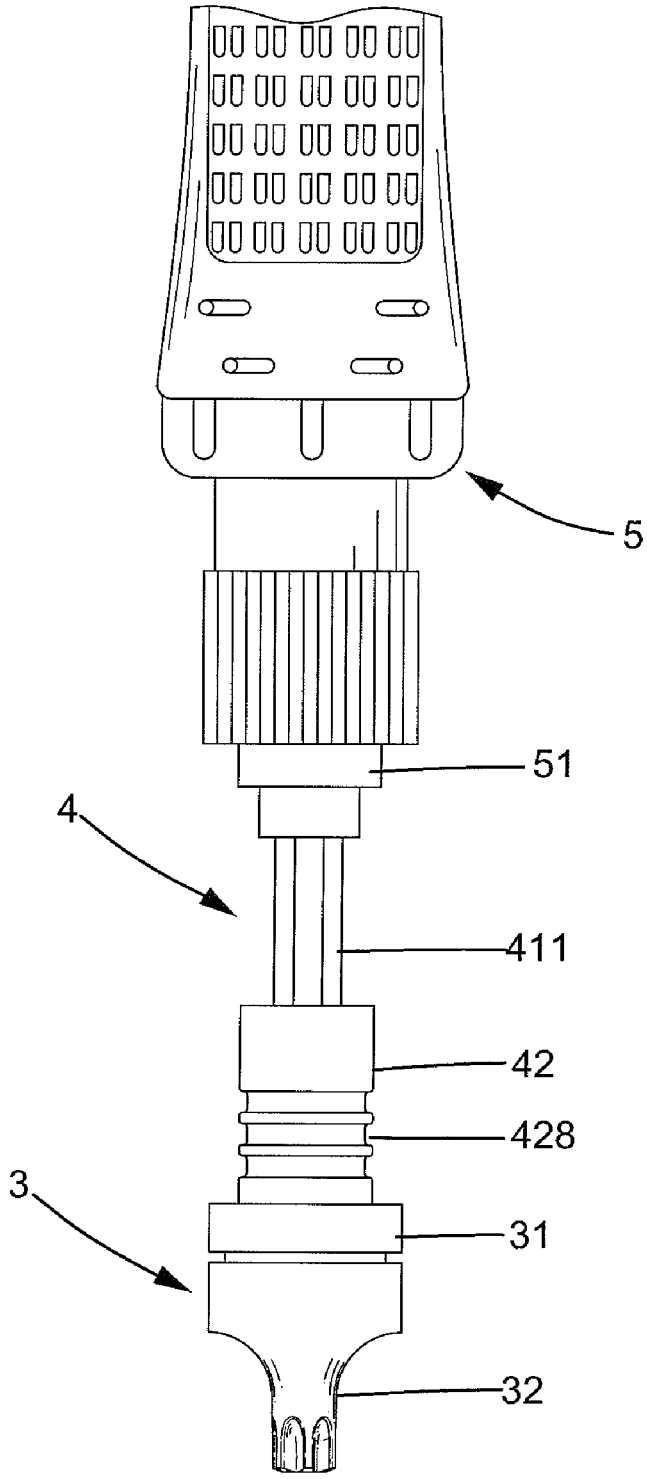
FIG. 5 shows a diagrammatic side view of the quick-release coupler and the bit of FIG. 2 and a pneumatic tool to which the quick-release coupler is coupled.

A quick-release coupler according to the preferred teachings of the present invention is shown in FIGS. 2 through 9 of the drawings and is designated 4. According to the preferred form shown, quick-release coupler 4 includes a rod 41 includes first and second sections 410 and 419 spaced in an axial direction. First section 410 has polygonal cross sections perpendicular to the axial direction. According to the most preferred form shown, first section 410 has hexagonal cross sections, and second section 419 has circular cross sections smaller than the hexagonal cross sections of first section 410. First section 410 of rod 41 includes a first end 411 having an annular groove 413 by which rod 41 can be secured to a coupling end 51 of a pneumatic tool 5 (FIG. 5). First section 410 of rod 41 further includes a second end 60 having an end face 414 from which second section 419 extends in the axial direction. A distal end 412 of second section 419 has a recess 415. According to the most preferred form shown, recess 415 includes a first, inclined contact section 416 adjacent to an end face 418 of distal end 412 and a second contact section 417 extending toward end face 411 from a lower end of first contact section 416. Second contact section 417 is intermediate first contact section 416 and end face 414 of first section 410 in the axial direction. A depth from first contact section 416 to an outer periphery of second section 419 of rod 41 in a radial direction perpendicular to the axial direction is smaller than that from second contact section 417 to the outer periphery of second section 419 of rod 41 in the radial direction. Namely, first contact section 416 has a depth in the radial direction smaller than second contact section 417.

According to the preferred form shown, a sleeve 42 is mounted around rod 41 and slideable relative to rod 41 in the axial direction. Sleeve 42 includes a first end 421, a second end 422 spaced from first end 421 in the axial direction and adapted to couple with a bit 3, and an axial bore 423 extending from first end 421 through second end 422 in the axial direction. A shoulder 426 is formed between first and second ends 421 and 422 of sleeve 42. Several grooves 428 are provided on an outer periphery of sleeve 42 for secure holding by a user. Grooves 428 are intermediate first end 41 and shoulder 426 of sleeve 42 in the axial direction. Axial bore 423 includes a larger section 424 and a smaller section 429. Specifically, larger section 424 extends from first end 421 towards but spaced from second end 422 of sleeve 42 in the axial direction. Larger section 424 has an end face 427 extending transversely to the axial direction and facing first end 421 of sleeve 42. Larger section 424 has polygonal cross sections perpendicular to the axial direction and corresponding to the polygonal cross sections of first section 410 of rod 41. According to the most preferred form shown, larger section 424 has hexagonal cross sections corresponding to the hexagonal cross sections of first section 410 of rod 41. Smaller section 429 has circular cross sections corresponding to the circular cross sections of second section 419 of rod 41. A radial bore 425 is formed in second end 422 of sleeve 42. Radial bore 425 extends in the radial direction from an outer periphery of second end 422 of sleeve 42 through an inner periphery of smaller section 429 of axial bore 423. Thus, radial bore 425 is in communication with smaller section 429 of axial bore 423.

According to the preferred form shown, a ball 44 is movably received in radial bore 425 of sleeve 42 in the radial direction. A ring 45 is mounted in an outer end of radial bore 425 and has a diameter less than that of ball 44 so that only part of ball 44 can project out of radial bore 425 of sleeve 42. Ball 44 is also received in recess 415 of rod 41 to engage sleeve 42 with rod 41 and movable between first contact section 416 and second contact section 417 in the axial direction.

Figure 8:
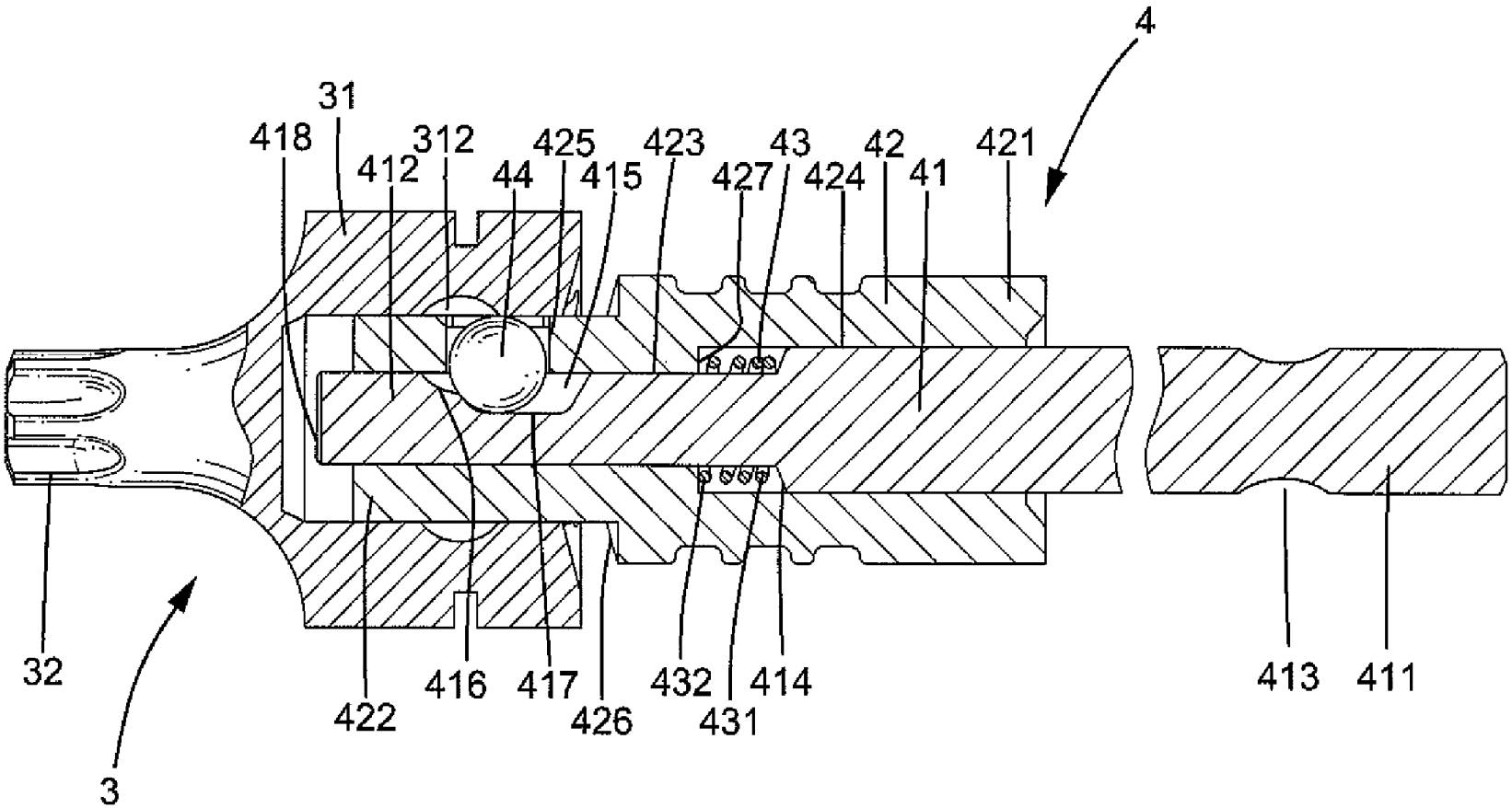
FIG. 8 is a view similar to FIG. 7, wherein the bit is moved to push a sleeve of the quick-release coupler in a retracted position, and a ball is received in the bit.

According to the preferred form shown, a spring 43 is received in larger section 424 of axial bore 423 of sleeve 42 for biasing sleeve 42 towards second end 412 of rod 41. Spring 43 has a first end 431 abutting against end face 414 of rod 41 and a second end 432 abutting against end face 427 of larger section 424. Sleeve 42 is moveable relative to rod 41 in the axial direction between an extended, first position (FIG. 4) and a retracted, second position (FIG. 8). Spring 43 biases sleeve 42 from the retracted, second position to the extended, first position. Spring 43 is compressed when sleeve 42 is in the retracted, second position.

Figure 6:
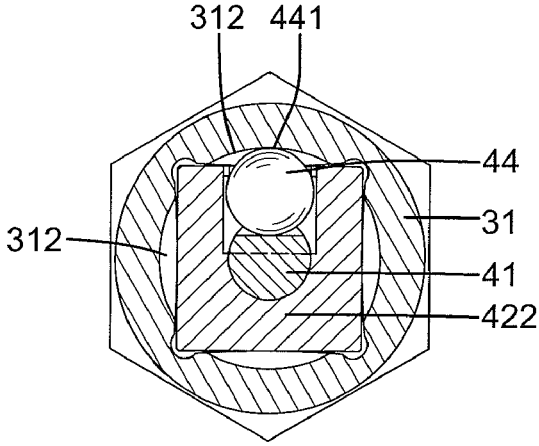
FIG. 6 is a cross sectional view taken along plane 6-6 in FIG. 2.

According to the preferred form shown, bit 3 includes a driving end 32 for driving a screw or the like. Bit 3 includes a socket portion 31 having a coupling hole 311 that is substantially square in cross section (FIG. 6). A recessed portion 312 is formed in each of four side walls defining coupling hole 311 and is substantially elliptic in cross section in the most preferred form shown. Coupling hole 311 of bit 3 can engage second end 422 of sleeve 42.

Figure 7:
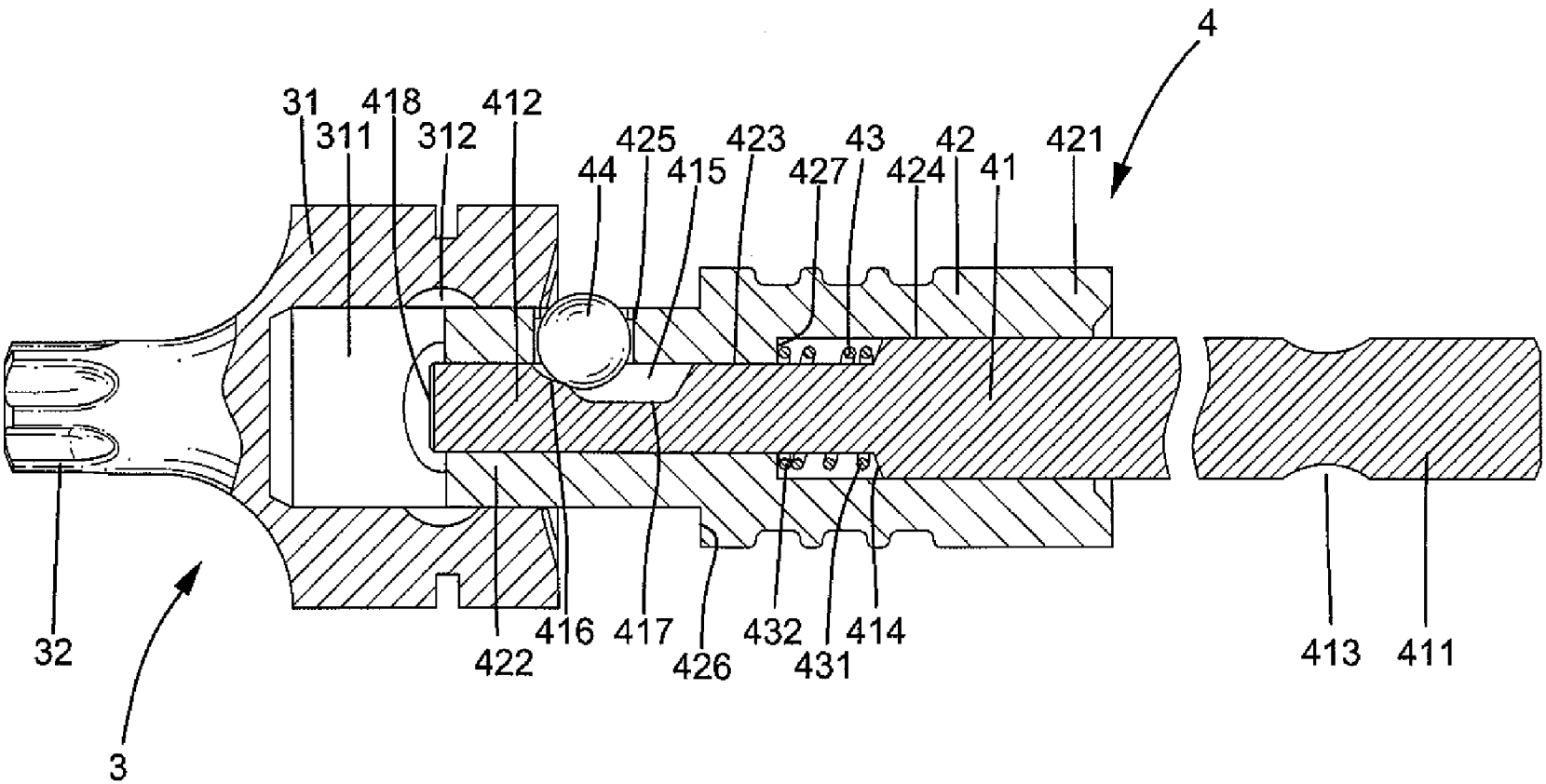
FIG. 7 is a view similar to FIG. 4, wherein the bit is being coupled with the quick-release coupler.

Referring to FIG. 4, when sleeve 42 is moved to the extended, first position, ball 44 is pushed by sleeve 42 and engages in first contact section 416 of recess 415. As mentioned above, first contact section 416 has a depth in the radial direction smaller than second contact section 417. Thus, when ball 44 is seated in first contact section 416, an outermost portion 441 of ball 44 projects out of radial bore 425 of sleeve 42 and engages one of recessed portions 312 of bit 3. Referring to FIG. 7, when sleeve 42 is moved to the retracted, second position, ball 44 engages second contact section 417 of recess 415 and does not project out of radial bore 425 of sleeve 42.

In assembly of quick-release coupler 4 according to the preferred teachings of the present invention, rod 41 is moved into axial bore 423 of sleeve 42 with first section 410 of rod 41 partially received in larger section 424 of axial bore 423 and with second section 419 of rod 41 received in smaller section 429 of axial bore 423. Since first section 410 of rod 41 and larger section 424 of axial bore 423 have corresponding hexagonal cross sections, first section 410 of rod 41 can be easily inserted into larger section 424 of axial bore 423 with recess 415 of rod 41 always facing the same direction as radial bore 425 of sleeve 42. This is because sleeve 42 will not rotate relative to rod 41 during assembly. Thus, recess 415 of rod 41 will align with radial bore 425 of sleeve 42 after second section 419 of rod 41 is inserted into smaller section 429 of axial bore 423. Maintaining the angular position of recess 415 of rod 41 relative to radial bore 425 of sleeve 42 is, thus, not a problem during assembly of quick-release coupler 4 according to the preferred teachings of the present invention. Furthermore, quick-release coupler 4 according to the preferred teachings of the present invention includes only two major elements (i.e., rod 41 and sleeve 42) and a spring 43, which is much simpler than conventional quick-release couplers having more elements. The time required for assembling quick-release coupler 4 according to the preferred teachings of the present invention is saved, and mistakes during assembly of quick-release coupler 4 according to the preferred teachings of the present invention are less likely to occur. Further, the costs for manufacturing, assembling, labor, and management are cut while increasing efficiency and yield. Further, quick-release coupler 4 according to the preferred teachings of the present invention having fewer elements has a smaller accumulated tolerance than conventional quick-release couplers. The assembly accuracy and quality are improved to provide reliable functions during operation.

Figure 2:
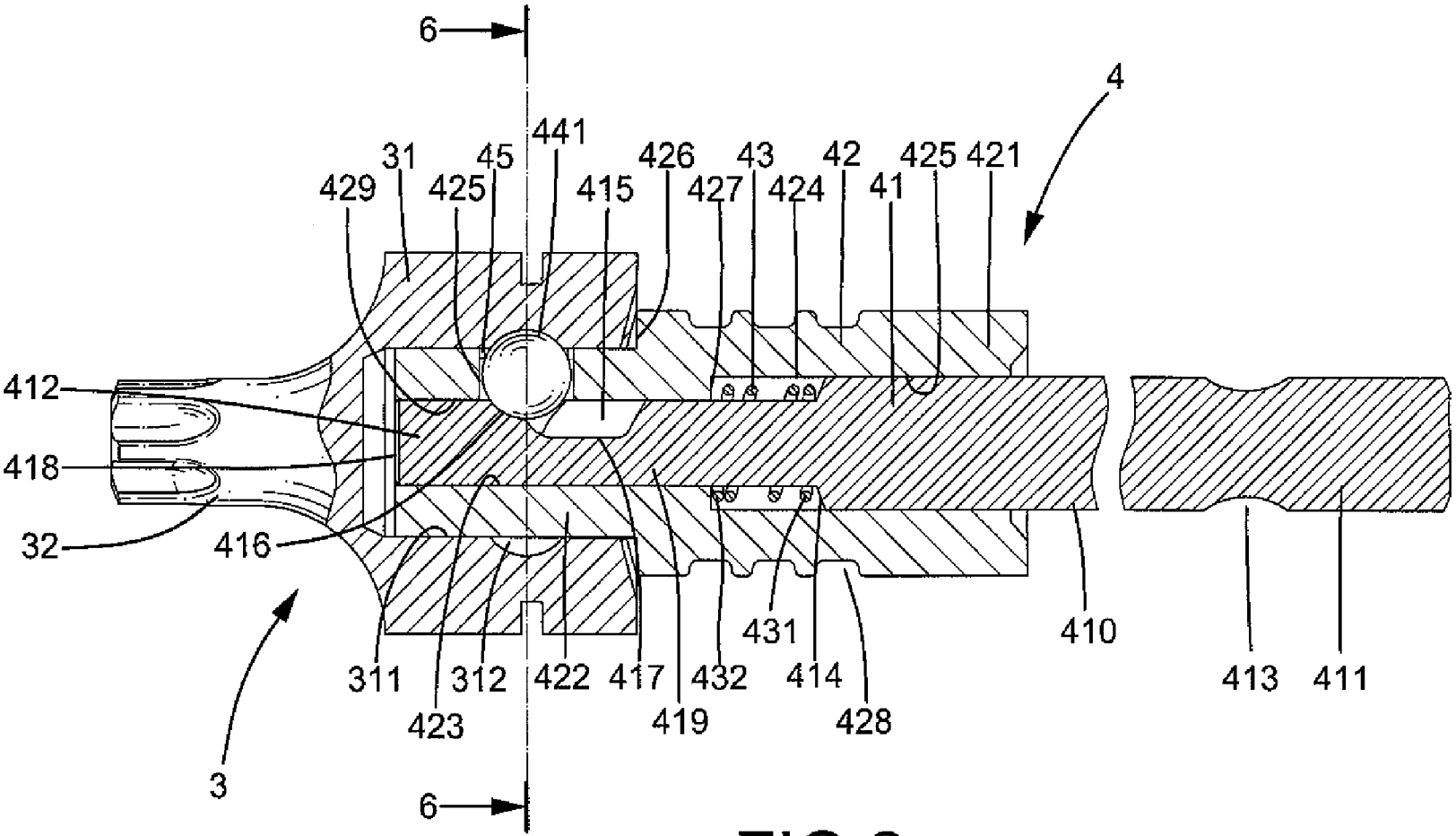
FIG. 2 shows a cross sectional view of a quick-release coupler according to the present invention with a bit attached thereto.
Figure 3:
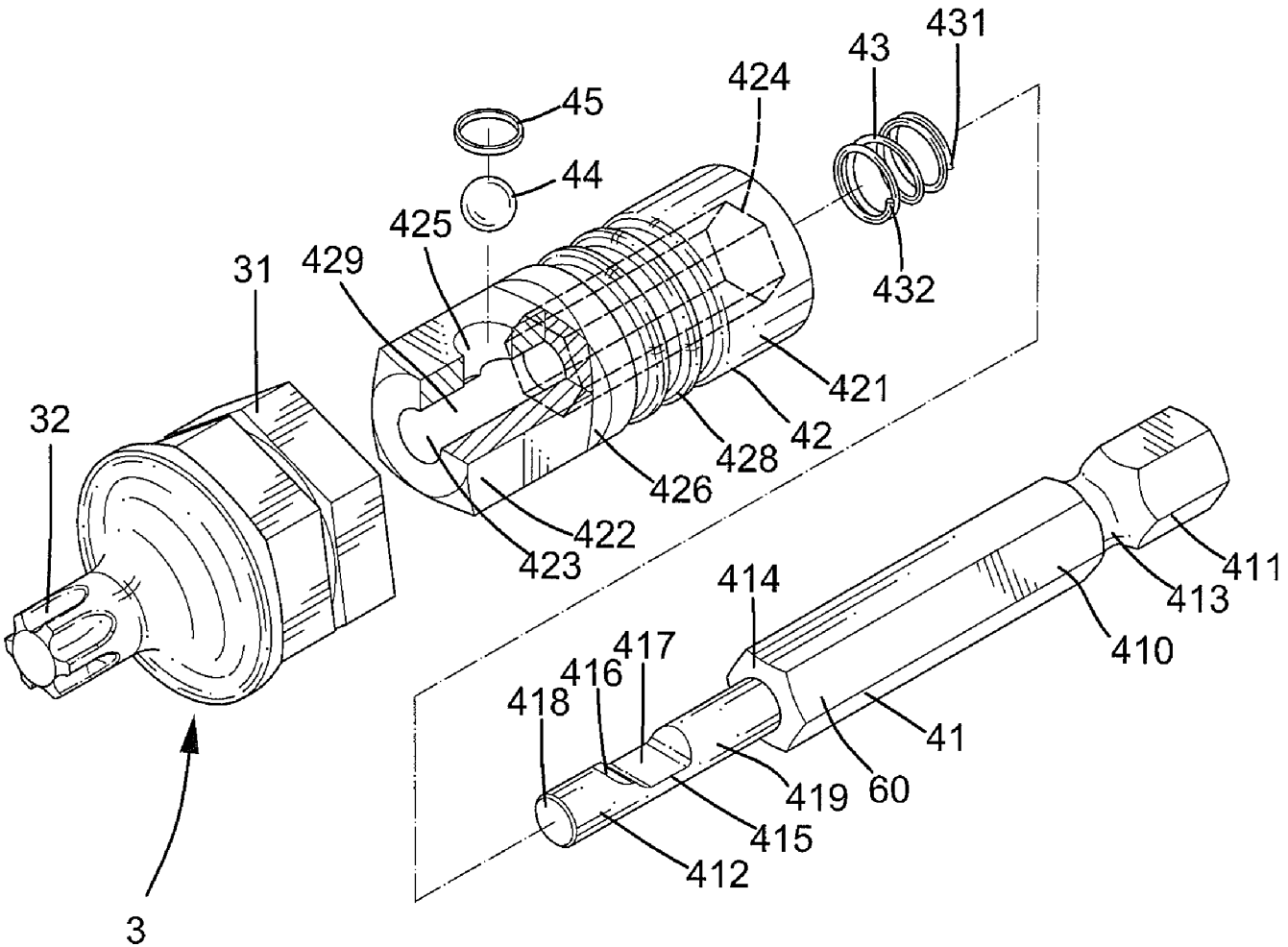
FIG. 3 shows an exploded, perspective view of the quick-release coupler and the bit of FIG. 2.
Figure 9:
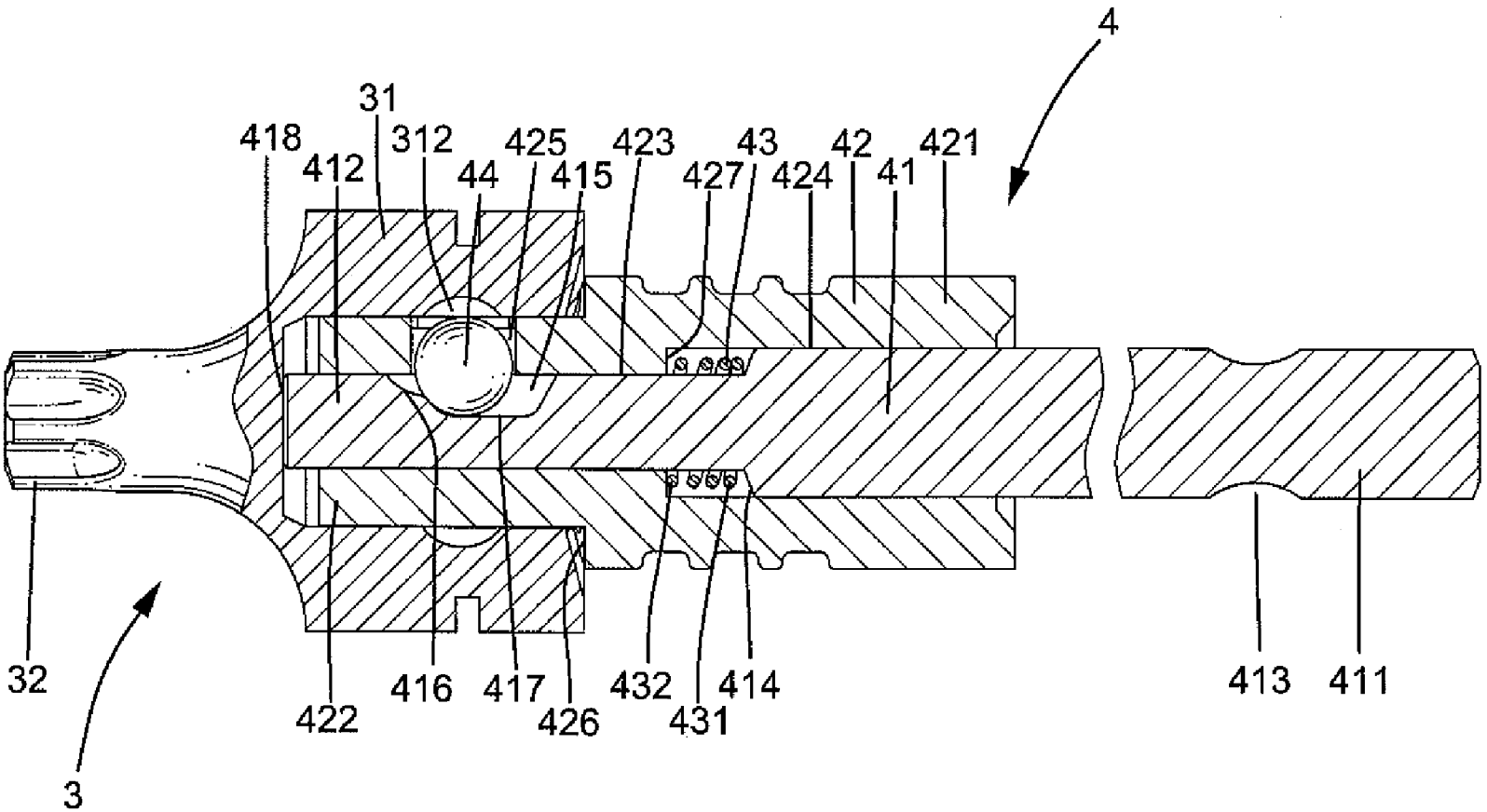
FIG. 9 is a view similar to FIG. 8, wherein the bit is moved to be in contact with a shoulder of the sleeve of the quick-release coupler.

Coupling of bit 3 with quick-release coupler 4 will now be described in detail. When bit 3 is initially engaged with second end 42 of quick-release coupler 4, one of the side walls of coupling hole 311 presses ball 44 and pushes sleeve 42, so that ball 44 moves inwardly relative to rod 41 in the radial direction, and spring 43 is compressed (FIG. 7). Then, sleeve 42 is moved to the retracted, second position (FIG. 8) to further compress spring 43, and ball 44 is released and drops from first contact section 416 into second contact section 417 of recess 415. Then, bit 3 is further moved towards sleeve 42 to contact shoulder 426 of sleeve 42, and ball 44 aligns with one of recessed portions 312 of bit 3 (FIG. 9). Then, when bit 3 is released, sleeve 42 and bit 3 are biased by spring 43, and sleeve 42 is moved to the extended, first position in which ball 44 is retained in place by engagement with first contact section 416 of recess 415 and recessed portion 312 of bit 3 (FIG. 2). Thus, bit 3 is securely locked on quick-release coupler 4 as shown in FIGS. 2 and 6 and can be driven when rod 41 of quick-release coupler 4 secured to pneumatic tool 5 rotates.

Coupling hole 311 of bit 3 is of a width such that one of recessed portions 312 of bit 3 is capable of aligning with the second contact section 417 of recess 415 when bit 3 is engaged with second end 422 of sleeve 42 (note that sleeve 42 moves to the retracted, second position). To remove bit 3 from quick-release coupler 4, the user needs only to grasp bit 3 (FIG. 2) and push bit 3 to make sleeve 42 move to the retracted, second position (FIG. 9) such that ball 44 no longer engages recessed portions 312 of bit 3, allowing bit 3 to be removed from sleeve 42 (FIG. 4) when the user firmly grips sleeve 42 and moves bit 3 away from sleeve 42.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A quick-release coupler (4) comprising:

a rod (41) including first and second sections (410, 419) spaced in an axial direction, with the first section (410) having a polygonal cross section perpendicular to the axial direction and including first and second ends (411, 60) spaced in the axial direction, with the first end (411) of the first section (410) adapted to couple with a pneumatic tool (5), with the second end (60) of the first section (410) having an end face (414), with the second section (419) extending from the end face (414) of the second end (60) of the first section (410) and including a distal end (412) having a recess (415), with the recess (415) including a first contact section (416) and a second contact section (417) intermediate the first contact section (416) and the end face (414) of the first section (410) in the axial direction, with a depth from the first contact section (416) in a radial direction perpendicular to the axial direction to an outer periphery of the second section (419) of the rod (41) being smaller than that from the second contact section (417) to the outer periphery of the second section (419) of the rod (41) in the radial direction;

a sleeve (42) mounted around the rod (41) and moveable relative to the rod (41) in the axial direction between an extended, first position and a retracted, second position, with the sleeve (42) including first and second ends (421, 422) spaced in the axial direction, with the second end (422) of the sleeve (42) adapted to couple with a bit (3), with an axial bore (423) extending from the first end (421) of the sleeve (42) through the second end (422) of the sleeve (42) in the axial direction, with the axial bore (423) including larger and smaller sections (424 and 429), with the larger section (424) having a polygonal cross section perpendicular to the axial direction and corresponding to the the polygonal cross section of the first section (410) of the rod (41), with a radial bore (425) extending in the radial direction from an outer periphery of the second end (422) of the sleeve (42) through an inner periphery of the smaller section (429) of the axial bore (423), with the radial bore (425) aligned with the recess (415) of the second section (419) of the rod (41);

a ball (44) movably received in the radial bore (425) of sleeve (42) in the radial direction and moveably received in the recess (415) of the second section (419) of the rod (41) in the axial and radial directions, with the ball (44) releasably engaging the sleeve (42) with the rod (41); and a spring (43) mounted in the larger section (424) of the axial bore (423) of the sleeve (42) and biasing the sleeve (42) from the retracted, second position to the extended, first position, with the spring (43) being compressed when the sleeve (42) is in the retracted, second position, with the ball (44) being engaged in the first contact section (416) of the recess (415) with an outermost portion (441) of the ball (44) projecting out of the radial bore (425) of the sleeve (42) when the sleeve (42) is in the extended, first position, coupling the bit (3) with the second end (422) of the sleeve (42), with the ball (44) being engaged in the second contact section (417) of the recess (415) and not projecting out of the radial bore (425) of the sleeve (42) when the sleeve (42) is in the retracted, second position, allowing the bit (3) to be disengaged from the second end (422) of the sleeve (42).

2. The quick-release coupler according to claim 1, with the larger section (424) of the axial bore (423) including an end face (427) extending transversely to the axial direction and facing the first end (421) of the sleeve (42), with the rod (41) further including an end face (414) between the first end (411) of the rod (41) and the second end (412) of the rod (41) in the axial direction, with the spring (43) including a first end (431) abutting against the end face (414) of the first section (410) of the rod (41) and a second end (432) abutting against the end face (427) of the larger section (424) of the sleeve (42).

* * * * *

US008070377C1

(12) INTER PARTES REEXAMINATION CERTIFICATE (1045th)

United States Patent
Wang

(10) Number: US 8,070,377 C1
(45) Certificate Issued: Jan. 29, 2015

(54) QUICK-RELEASE COUPLER

(76) Inventor: Tzu-Chien Wang, Tainan (TW)

Reexamination Request:
No. 95/002,103, Aug. 27, 2012

Reexamination Certificate for:

| | |
|---|---|
| Patent No.: | **8,070,377** |
| Issued: | **Dec. 6, 2011** |
| Appl. No.: | **12/618,825** |
| Filed: | **Nov. 16, 2009** |

Related U.S. Application Data

(63) Continuation-in-part of application No. 12/044,037, filed on Mar. 7, 2008, now abandoned.

(51) Int. Cl.
*B25G 3/18* (2006.01)

(52) U.S. Cl.
USPC ..... 403/322.2; 403/325; 81/177.2; 81/177.85

(58) Field of Classification Search
None
See application file for complete search history.

(56) References Cited

To view the complete listing of prior art documents cited during the proceeding for Reexamination Control Number 95/002,103, please refer to the USPTO's public Patent Application Information Retrieval (PAIR) system under the Display References tab.

*Primary Examiner* — Danton DeMille

(57) ABSTRACT

A quick-release coupler includes a rod having first and second sections. The first section includes an end for coupling with a pneumatic tool. The second section extends from the other end of the first section. A sleeve is slideably mounted around the rod and includes an end for releasably coupling a bit. The sleeve includes an axial bore having larger and smaller sections. The larger section has polygonal cross sections corresponding to polygonal cross sections of the first section. A radial bore is formed in the sleeve and in communication with the smaller section. A ball is moveably received in the radial bore and moveably received in a recess of the second section of the rod to releasably engage the sleeve with the bit. A spring is mounted in the larger section of the sleeve for biasing the sleeve towards the other end of the rod.

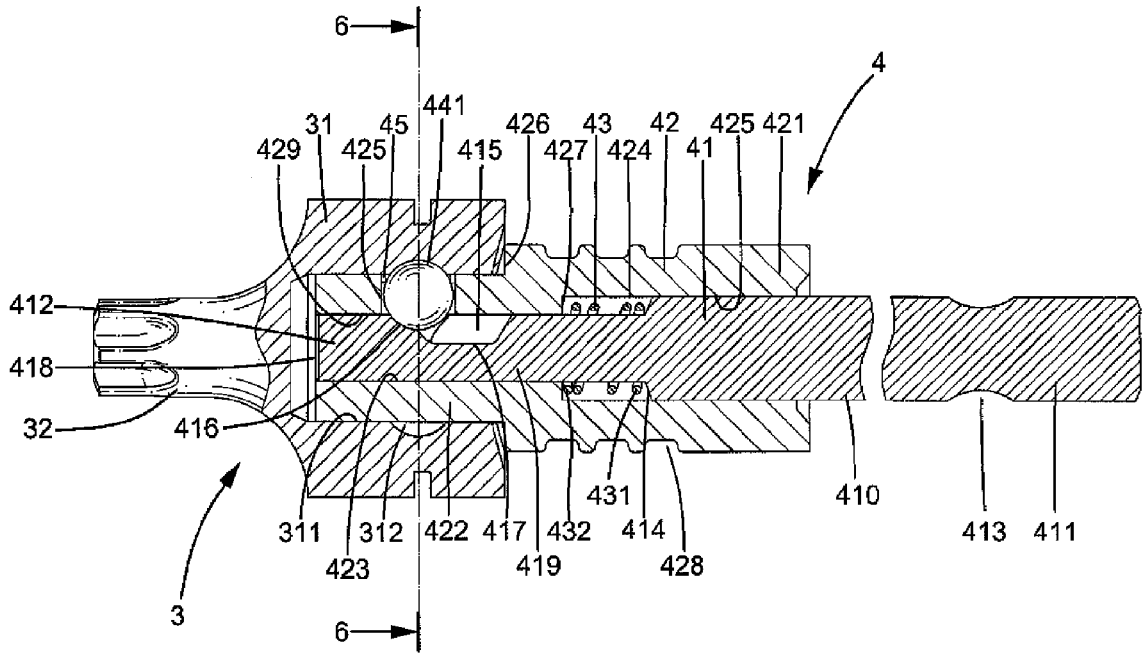

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 1, lines 41-56:

U.S. Pat. No. 6,874,392 discloses a connector for a hand tool including a connector seat coupled to an operation member. The connector seat includes a main body, a movable rod, a positioning ball, and at least one spring. The main body includes a square receiving portion having a positioning hole that partially receives the positioning ball. The main body is movable relative to an operation seat of the operation member to retract the positioning ball into a receiving cavity of the movable rod, so that a socket can be mounted on and detached from the connector easily and conveniently, thereby saving [the] manual work. However, aligning the receiving cavity of the movable rod with the positioning hole of the square receiving portion of the main body while inserting the movable rod into the main body is not always easy, for the movable rod having circular cross sections may rotate relative to the main body also having circular cross sections.

Column 3, lines 1-2:

FIG. 7 is a view similar to FIG. 4, wherein the bit is [being] coupled with the quick-release coupler.

Column 3, lines 31-59:

A quick-release coupler according to the preferred teachings of the present invention is shown in FIGS. 2 through 9 of the drawings and is designated 4. According to the preferred form shown, quick-release coupler 4 includes a rod 41 [includes] *including* first and second sections 410 and 419 spaced in an axial direction. First section 410 has polygonal cross sections perpendicular to the axial direction. According to the most preferred form shown, first section 410 has hexagonal cross sections, and second section 419 has circular cross sections smaller than the hexagonal cross sections of first section 410. First section 410 of rod 41 includes a first end 411 having an annular groove 413 by which rod 41 can be secured to a coupling end 51 of a pneumatic tool 5 (FIG. 5). First section 410 of rod 41 further includes a second end 60 having an end face 414 from which second section 419 extends in the axial direction. A distal end 412 of second section 419 has a recess 415. According to the most preferred form shown, recess 415 includes a first, inclined contact section 416 adjacent to an end face 418 of distal end 412 and a second contact section 417 extending toward end face [411] *414* from a lower end of first contact section 416. Second contact section 417 is intermediate first contact section 416 and end face 414 of first section 410 in the axial direction. A depth from first contact section 416 to an outer periphery of second section 419 of rod 41 in a radial direction perpendicular to the axial direction is smaller than that from second contact section 417 to the outer periphery of second section 419 of rod 41 in the radial direction. Namely, first contact section 416 has a depth in the radial direction smaller than second contact section 417.

Column 3, line 60 to Column 4, line 21:

According to the preferred form shown, a sleeve 42 is mounted around rod 41 and slideable relative to rod 41 in the axial direction. Sleeve 42 includes a first end 421, a second end 422 spaced from first end 421 in the axial direction and adapted to couple with a bit 3, and an axial bore 423 extending from first end 421 through second end 422 in the axial direction. A shoulder 426 is formed between first and second ends 421 and 422 of sleeve 42. Several grooves 428 are provided on an outer periphery of sleeve 42 for secure holding by a user. Grooves 428 are intermediate first end [41] *421* and shoulder 426 of sleeve 42 in the axial direction. Axial bore 423 includes a larger section 424 and a smaller section 429. Specifically, larger section 424 extends from first end 421 towards but spaced from second end 422 of sleeve 42 in the axial direction. Larger section 424 has an end face 427 extending transversely to the axial direction and facing first end 421 of sleeve 42. Larger section 424 has polygonal cross sections perpendicular to the axial direction and corresponding to the polygonal cross sections of first section 410 of rod 41. According to the most preferred form shown, larger section 424 has hexagonal cross sections corresponding to the hexagonal cross sections of first section 410 of rod 41. Smaller section 429 has circular cross sections corresponding to the circular cross sections of second section 419 of rod 41. A radial bore 425 is formed in second end 422 of sleeve 42. Radial bore 425 extends in the radial direction from an outer periphery of second end 422 of sleeve 42 through an inner periphery of smaller section 429 of axial bore 423. Thus, radial bore 425 is in communication with smaller section 429 of axial bore 423.

Column 4, lines 31-41:

According to the preferred form shown, a spring 43 is received in larger section 424 of axial bore 423 of sleeve 42 for biasing sleeve 42 towards [second] *distal* end 412 of rod 41. Spring 43 has a first end 431 abutting against end face 414 of rod 41 and a second end 432 abutting against end face 427 of larger section 424. Sleeve 42 is moveable relative to rod 41 in the axial direction between an extended, first position (FIG. 4) and a retracted, second position (FIG. 8). Spring 43 biases sleeve 42 from the retracted, second position to the extended, first position. Spring 43 is compressed when sleeve 42 is in the retracted, second position.

Column 5, lines 29-47:

Coupling of bit 3 with quick-release coupler 4 will now be described in detail. When bit 3 is initially engaged with second end [42] *422* of quick-release coupler 4, one of the side walls of coupling hole 311 presses ball 44 and pushes sleeve 42, so that ball 44 moves inwardly relative to rod 41 in the radial direction, and spring 43 is compressed (FIG. 7). Then, sleeve 42 is moved to the retracted, second position (FIG. 8) to further compress spring 43, and ball 44 is released and drops from first contact section 416 into second contact section 417 of recess 415. Then, bit 3 is further moved towards sleeve 42 to contact shoulder 426 of sleeve 42, and ball 44 aligns with one of recessed portions 312 of bit 3 (FIG. 9).

Then, when bit 3 is released, sleeve 42 and bit 3 are biased by spring 43, and sleeve 42 is moved to the extended, first position in which ball 44 is retained in place by engagement with first contact section 416 of recess 415 and recessed portion 312 of bit 3 (FIG. 2). Thus, bit 3 is securely locked on quick-release coupler 4 as shown in FIGS. 2 and 6 and can be driven when rod 41 of quick-release coupler 4 secured to pneumatic tool 5 rotates.

AS A RESULT OF REEXAMINATION, IT HAS BEEN DETERMINED THAT:

Claims 1 and 2 are cancelled.

* * * * *